US007971933B2

(12) United States Patent
Tuckey et al.

(10) Patent No.: US 7,971,933 B2
(45) Date of Patent: Jul. 5, 2011

(54) HANDLE FOR INFANT CARRIER

(75) Inventors: Peter R. Tuckey, Morgantown, PA (US); Sharon A. Gillett, Shillington, PA (US)

(73) Assignee: Wonderland Nurserygoods Co., Ltd, Taipei (TW)

( * ) Notice: Subject to any disclaimer, the term of this patent is extended or adjusted under 35 U.S.C. 154(b) by 217 days.

(21) Appl. No.: 11/778,468

(22) Filed: Jul. 16, 2007

(65) Prior Publication Data

US 2008/0018145 A1 Jan. 24, 2008

Related U.S. Application Data

(60) Provisional application No. 60/856,768, filed on Nov. 3, 2006, provisional application No. 60/831,833, filed on Jul. 19, 2006.

(51) Int. Cl.
*A47C 1/08* (2006.01)

(52) U.S. Cl. ..... 297/256.16; 297/256.12; 297/183.4; 472/118

(58) Field of Classification Search ..... 297/250.1, 297/256.1, 273–281, 183.1–183.7, 256.12, 297/256.16; 472/188–121
See application file for complete search history.

(56) References Cited

U.S. PATENT DOCUMENTS

| | | | | |
|---|---|---|---|---|
| 4,516,806 | A | 5/1985 | McDonald | 297/457 |
| 5,207,476 | A | 5/1993 | Payne | 297/183 |
| 5,277,472 | A * | 1/1994 | Freese et al. | 297/130 |
| 5,322,343 | A * | 6/1994 | Parker et al. | 297/183.3 |
| 5,562,548 | A * | 10/1996 | Pinch et al. | 472/119 |
| 5,984,791 | A * | 11/1999 | Fair et al. | 472/118 |
| 6,017,088 | A * | 1/2000 | Stephens et al. | 297/256.16 |
| 6,196,629 | B1 * | 3/2001 | Onishi et al. | 297/256.12 |
| D451,714 | S | 12/2001 | Cone | D6/500 |
| 6,386,986 | B1 * | 5/2002 | Sonner et al. | 472/119 |
| 6,431,647 | B2 * | 8/2002 | Yamazaki | 297/256.12 |
| 6,454,350 | B1 * | 9/2002 | Celestina-Krevh et al. | 297/216.11 |
| 6,561,577 | B2 | 5/2003 | Kelly | 297/183.2 |
| 6,692,073 | B1 * | 2/2004 | Weathersby | 297/256.16 |
| 6,857,966 | B2 * | 2/2005 | Armbruster et al. | 472/118 |
| 6,916,249 | B2 * | 7/2005 | Meade | 472/119 |
| 7,073,859 | B1 * | 7/2006 | Wilson | 297/256.1 |
| 7,163,265 | B2 * | 1/2007 | Adachi | 297/256.12 |
| 7,338,122 | B2 * | 3/2008 | Hei et al. | 297/256.12 |
| 7,387,337 | B2 * | 6/2008 | Keegan et al. | 297/256.13 |
| 7,422,524 | B2 * | 9/2008 | Gregorian | 472/119 |
| 7,472,955 | B2 * | 1/2009 | Crane et al. | 297/256.16 |
| 2002/0113469 | A1 * | 8/2002 | Stern et al. | 297/256.16 |

* cited by examiner

*Primary Examiner* — David Dunn
*Assistant Examiner* — Erika Garrett
(74) *Attorney, Agent, or Firm* — Miller Law Group, PLLC

(57) ABSTRACT

An infant swing has a base member supported by hanger members for reciprocal movement. The base member is formed with an upwardly extending mounting protrusion that nests into a mating receiver structure formed on the bottom of the seat carrier. A latch mechanism carried by the seat carrier is selectively operable to disengage a pivoted, spring-loaded latch member mounted on the base member mounting protrusion. The seat carrier is formed with a pivoted lift handle that provides a dual lift function, including the normal lift function associated with the lift handle being raised into the upright operative position. The lift handle is formed with grip openings adjacent the pivot connection of the lift handle such that the grip handles are rotated for access when the lift handle is lowered to the folded position to enable the seat carrier to be lifted by grasping the two transversely spaced grip openings.

17 Claims, 20 Drawing Sheets

Fig. 8
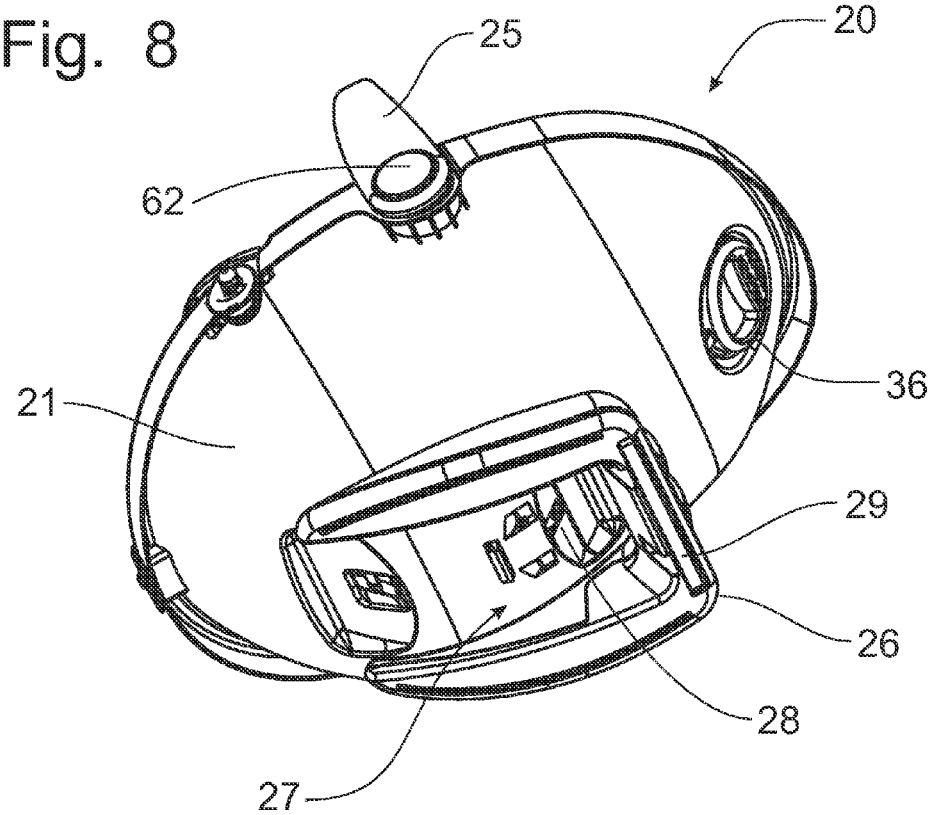
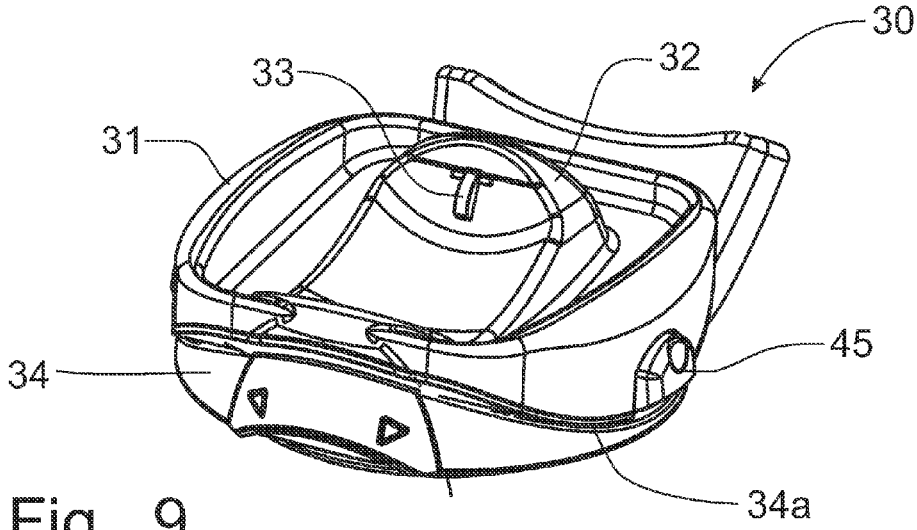
Fig. 9

Fig. 11
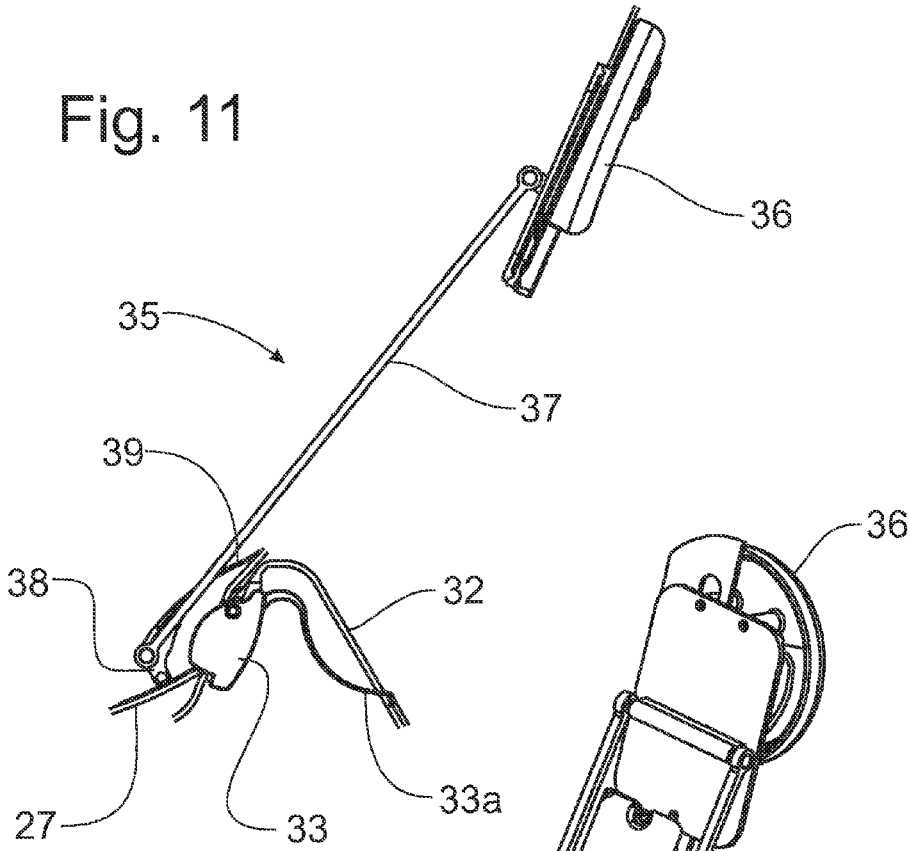
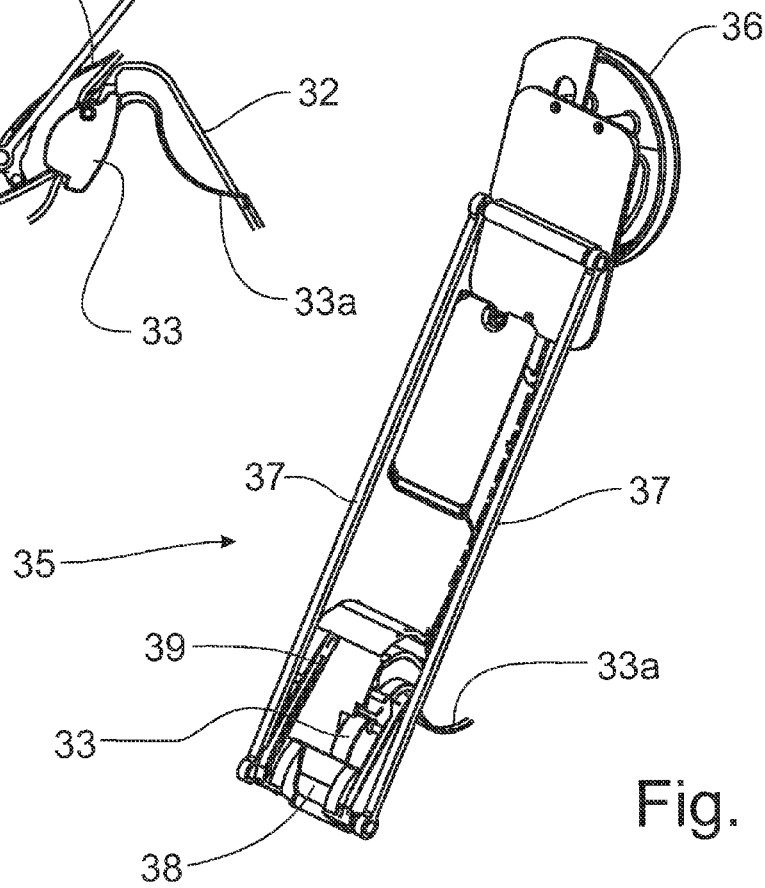
Fig. 12

Fig. 14
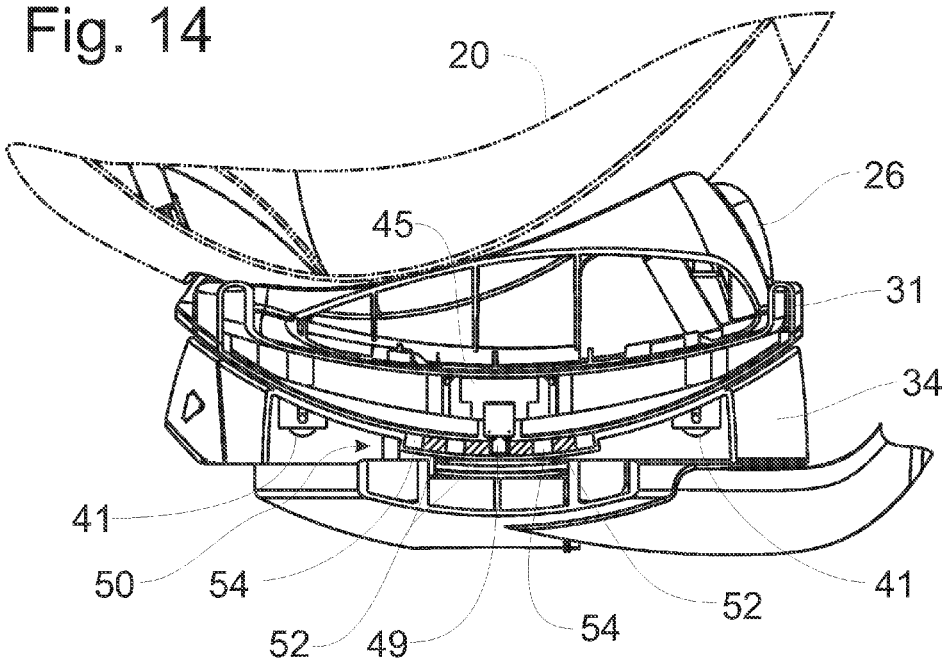
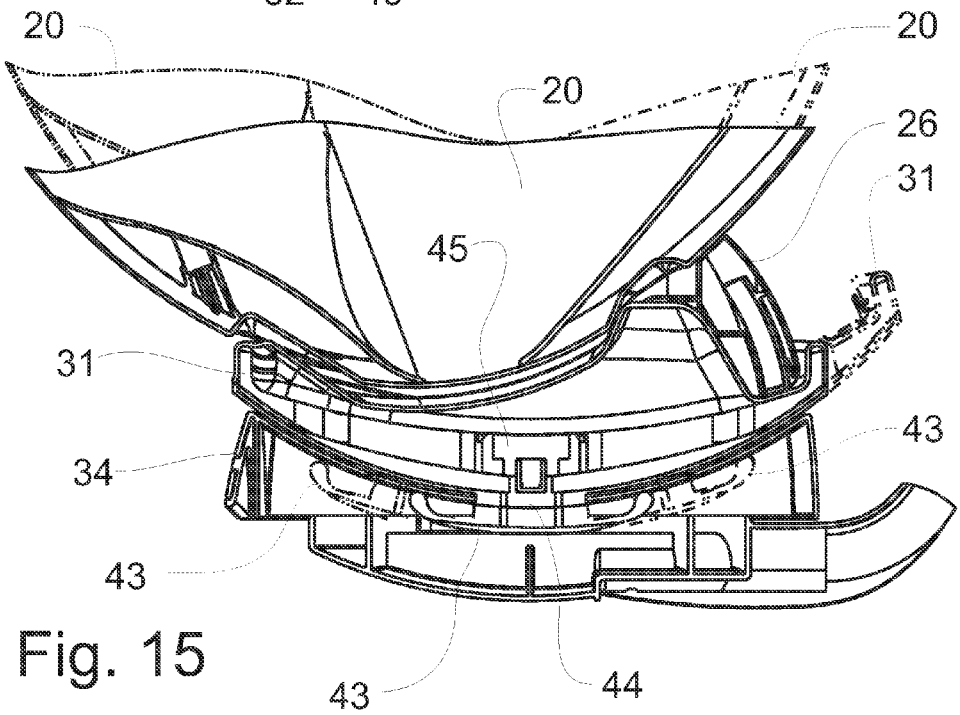
Fig. 15

Fig. 20
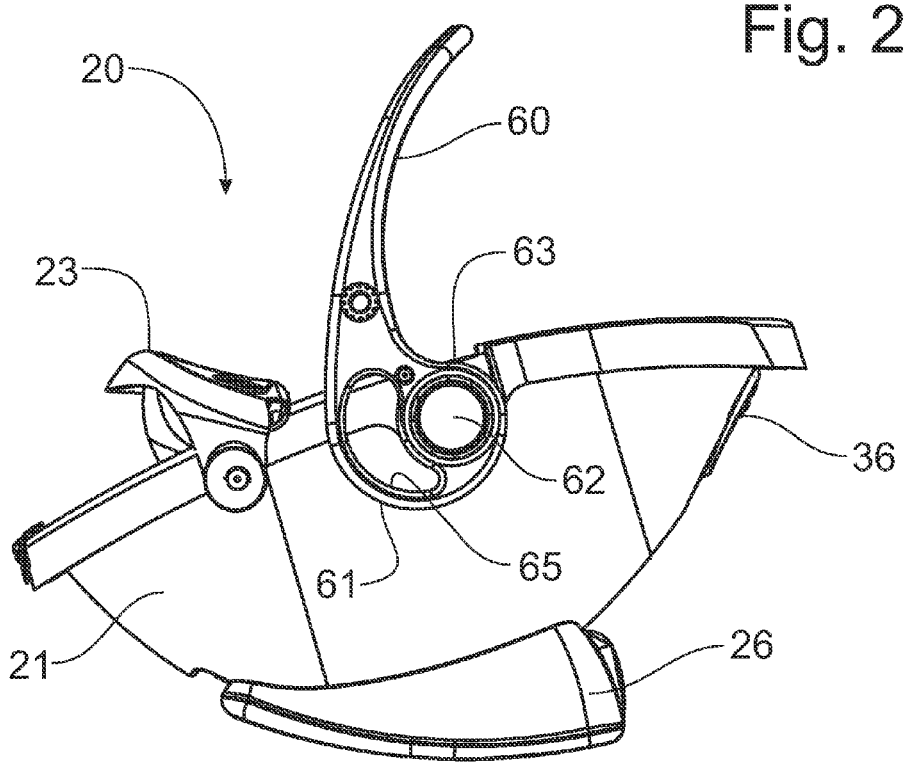
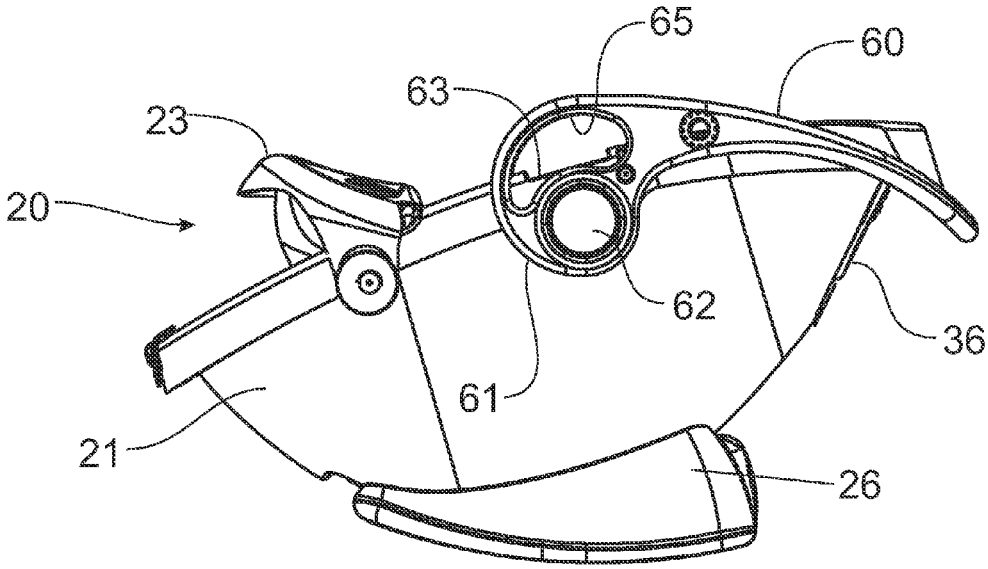
Fig. 21

Fig. 28
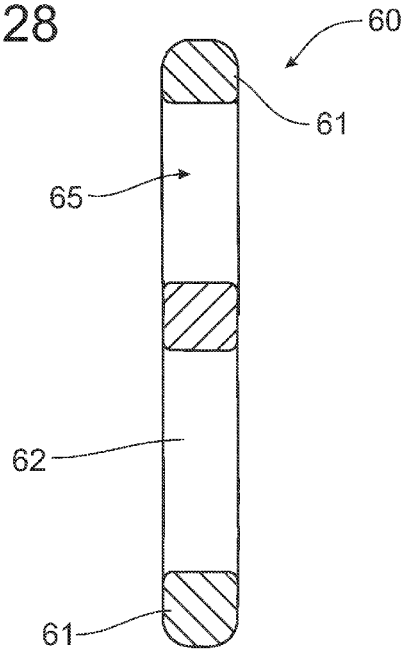
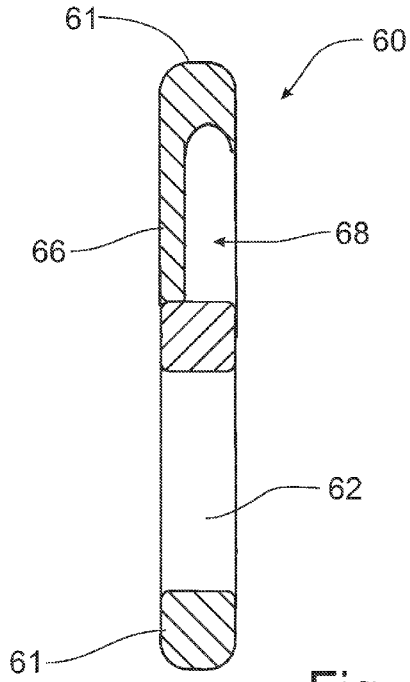
Fig. 29

HANDLE FOR INFANT CARRIER

CROSS-REFERENCE TO RELATED APPLICATIONS

This application claims priority on U.S. Provisional Patent Application Ser. No. 60/831,833, filed on Jul. 19, 2006; and on U.S. Provisional Patent Application Ser. No. 60/856,768, filed on Nov. 3, 2006, the contents of both provisional applications being incorporated herein by reference.

FIELD OF THE INVENTION

The present invention relates generally to a lift off carrier swing and, more particularly, to a handle that provides dual lifting functions for the infant seat.

BACKGROUND OF THE INVENTION

Baby swings are used extensively by infant caregivers to soothe and to comfort the children. An infant swing consists primarily of a seat that securely holds the infant in a position elevated off the floor and a frame apparatus that supports the seat and allows the seat to move in a reciprocal manner, typically in a forward and rearward direction though some infant seats provide a side to side swinging motion. Such swings provide a comfortable, safe and entertaining environment to the child.

When caring for an infant, it is extremely advantageous to be able to provide an environment that minimally disturbs the infant when they are resting or sleeping. The necessity to physically move an infant out of one seat and place them in another seat is usually agitating to the infant. Additionally, having the versatility to be able to provide a swinging motion to the specific seat an infant is occupying is also valuable. Therefore, having a swing that would allow either a carrier or a car seat to be directly attached to it would provide the caregiver with the option of being able to provide a swinging motion to the infant without moving the infant from one seat to the other. One such convertible swing system can be found in U.S. Pat. No. 6,017,088, issued on Jan. 25, 2000, to William Stephens, et al, in which a seat member is detachably mounted on a base member through a locking mechanism.

Accordingly, it would be advantageous to provide a mechanical interface connection on a swing hanger system to which either a car seat or baby carrier can be attached. This mechanical interface connection allows the caregiver to directly attach either a car seat, or an infant carrier to the hanger system to transfer a sleeping child from one support system to a swing system.

The lift handle in U.S. Pat. No. 5,207,476, issued to Timothy Paine on May 4, 1993, is formed in a bifurcated manner with a longitudinal link extending between the two portions of the lift handle to provide the caregiver with the option of gripping the lift handle with the hand turned to grasp the longitudinal link. Similarly, the lift handle is formed with a longitudinal grip member at the bight portion in U.S. Pat. No. 6,017,088, issued on Jan. 25, 2000, to William Stephens, et al, and in PCT Publication WO 96/12429, published on May 2, 1996, to enable the caregiver to grip the lift handle with the hand turned in a more natural and less stressful orientation. U.S. Pat. No. 6,561,577, granted to Joseph Kelly on May 13, 2003, discloses a positionally adjustable lift handle, but does not provide a dual lifting function when the handle is lowered to a folded position.

U.S. Pat. No. 4,516,806, granted on May 14, 1985, to Quentin McDonald, et al discloses an infant carrier having a lift handle pivotally attached to the opposing sides of the frame of the infant seat such that the lift handle can be positioned in an upwardly extending operative position and a lowered inoperative position. The opposing sides of the infant seat is formed with handle grips that are independent of the lift handle and can be used to lift the infant seat whether the lift handle is raised or lowered. The design of a carrying handle, which can be used on an infant seat, is disclosed in U.S. Design Pat. No. D451,714, granted to Richard Cone II on Dec. 11, 2001, wherein the handle is formed with openings located above the pivot point of the handle for aesthetic purposes. Because the openings are located above the pivot of the carrying handle, these openings would be located below the top surface of the infant seat when the carrying handle is pivoted into a lowered, inoperative, folded position. Thus, this carrying handle would not provide a dual function for lifting the infant seat when folded, assuming that the carrying handle were placed on an infant seat.

Accordingly, it would be desirable to provide a recline mechanism for a swing system that could be actuated with a single hand. It would further be desirable to provide a recline mechanism that would be housed within the hanger system on which a removable seat member can be detachably mounted. It would also be desirable to provide a lift handle for the seat carrier that is operable to provide a dual lift function, including the normal upright, operative position, but also including the lowered, folded position.

SUMMARY OF THE INVENTION

It is an object of this invention to provide an infant swing that overcomes the aforementioned disadvantages of the prior art.

It is another object of this invention to provide an infant swing that includes a base member adapted to detachably receive a seat member that can be used in multiple configurations.

It is a feature of this invention that the infant swing incorporates a locking mechanism that can be actuated with one hand to affect a removal of the seat from the base member.

It is another feature of this invention that the mating configurations of the seat and the base member include a spring-loaded latch member in the base member that is receivable within a latch opening in the seat to secure the seat to the base member.

It is still another feature of this invention that the seat is formed with a pivoted actuator that is connected to an external pull member to force the spring-loaded latch member out of the latch opening when the seat is to be removed from the base member.

It is an advantage of this invention that the seat can be latched to the base member simply by sitting the seat member on top of the base member with the latch member aligned with the latch opening.

It is another advantage of this invention that the seat can be easily removed from the base member by simply pulling the release pull member to force the latch member out of engagement with the seat.

It is still another object of this invention to provide a lift handle for the infant seat carrier that will provide a dual lift function.

It is yet another object of this invention to provide a lift handle that will provide a lift function even when the overhead lift handle is lowered to gain access to the seat for ingress and egress of the infant.

It is yet another feature of this invention that the overhead lift handle is formed with a grip opening adjacent the pivot connection of the lift handle to the frame of the seat carrier.

It is still another feature of this invention that the grip openings are rotated into an accessible, operative position when the lift handle is pivotally lowered into a folded position.

It is still another advantage of this invention that the seat carrier can be lifted by grasping the transversely spaced grip openings that are exposed for access when the lift handle is lowered to a folded position.

It is yet another advantage of this invention that the lift handle provides a lift function when raised into the upright, overhead position, and when lowered into the folded position.

It is still another advantage of this invention that the grip openings are positioned for access by the caregiver when the lift handle is lowered into the folded orientation.

It is a further feature of this invention that the grip openings extend forwardly of the pivot connection of the lift handle when the lift handle is raised into the overhead position so that rotation of the lift handle to the lowered position will position the grip openings for access.

It is still a further feature of this invention that the grip openings are formed to be concentric with the pivot axis of the lift handle.

It is a further advantage of this invention that the position of the grip openings move from forwardly of the pivot connection of the lift handle to a position above the pivot connection of the lift handle when the lift handle is pivotally moved from the raised, overhead position to the lowered position.

It is yet a further feature of this invention that the grip openings can be formed in a semi-circular shape to be accessible whether the handle is raised or lowered.

It is still a further advantage of this invention that the grip openings can be configured to provide a two-hand lift function whether the handle is raised or lowered.

It is a further object of this invention to provide an infant swing incorporating a lift-off seat, which is durable in construction, inexpensive of manufacture, carefree of maintenance, facile in assemblage, and simple and effective in use.

It is still a further object of this invention to provide a lift handle for a infant seat carrier that provides a dual lift function and which is durable in construction, inexpensive of manufacture, carefree of maintenance, facile in assemblage, and simple and effective in use.

These and other objects, features and advantages are accomplished according to the instant invention by providing an infant swing having a base member supported by hanger members for reciprocal movement. The base member is formed with an upwardly extending mounting protrusion that nests into a mating receiver structure formed on the bottom of the seat carrier. A latch mechanism carried by the seat carrier is selectively operable to disengage a pivoted, spring-loaded latch member mounted on the base member mounting protrusion. The seat carrier is formed with a pivoted lift handle that provides a dual lift function, including the normal lift function associated with the lift handle being raised into the upright operative position. The lift handle is formed with grip openings adjacent the pivot connection of the lift handle such that the grip handles are rotated for access when the lift handle is lowered to the folded position to enable the seat carrier to be lifted by grasping the two transversely spaced grip openings.

BRIEF DESCRIPTION OF THE DRAWINGS

The advantages of this invention will be apparent upon consideration of the following detailed disclosure of the invention, especially when taken in conjunction with the accompanying drawings wherein:

FIG. 8 is bottom, side perspective view of the seat carrier to depict the mounting structure of the seat carrier for engagement with the base member;

FIG. 9 is a top, side perspective view of the base member to depict the mounting structure of the base member for engagement with the seat carrier;

FIG. 11 is an enlarged elevational detail view of the latch linkage for securing the seat carrier on the base member;

FIG. 12 is an enlarged perspective detail view of the latch linkage shown in FIG. 11;

FIG. 14 is a cross-sectional view of the base member taken along lines 14-14 of FIG. 4 to depict the slotted channels that lock the seat carrier in a selected recline position, a portion of the seat carrier being shown in phantom;

FIG. 15 is a cross-sectional view of the base member taken along lines 15-15 of FIG. 4 to show the mounting plate for the seat member to permit selective recline positioning thereof, the movement of the seat carrier and attached top plate being shown in phantom to either side of the centered position shown in solid lines;

FIG. 20 is a left side elevational view of the seat carrier of FIG. 18;

FIG. 21 is a left side elevational view of the seat carrier of FIG. 19;

FIG. 28 is an enlarged cross-sectional view through the grip opening at the terminal of the lift handle; and FIG. 29 is an enlarged cross-sectional view similar to that of FIG. 28, but showing an alternative embodiment with the formation of a grip member.

DETAILED DESCRIPTION OF THE PREFERRED EMBODIMENT

Figure 1:
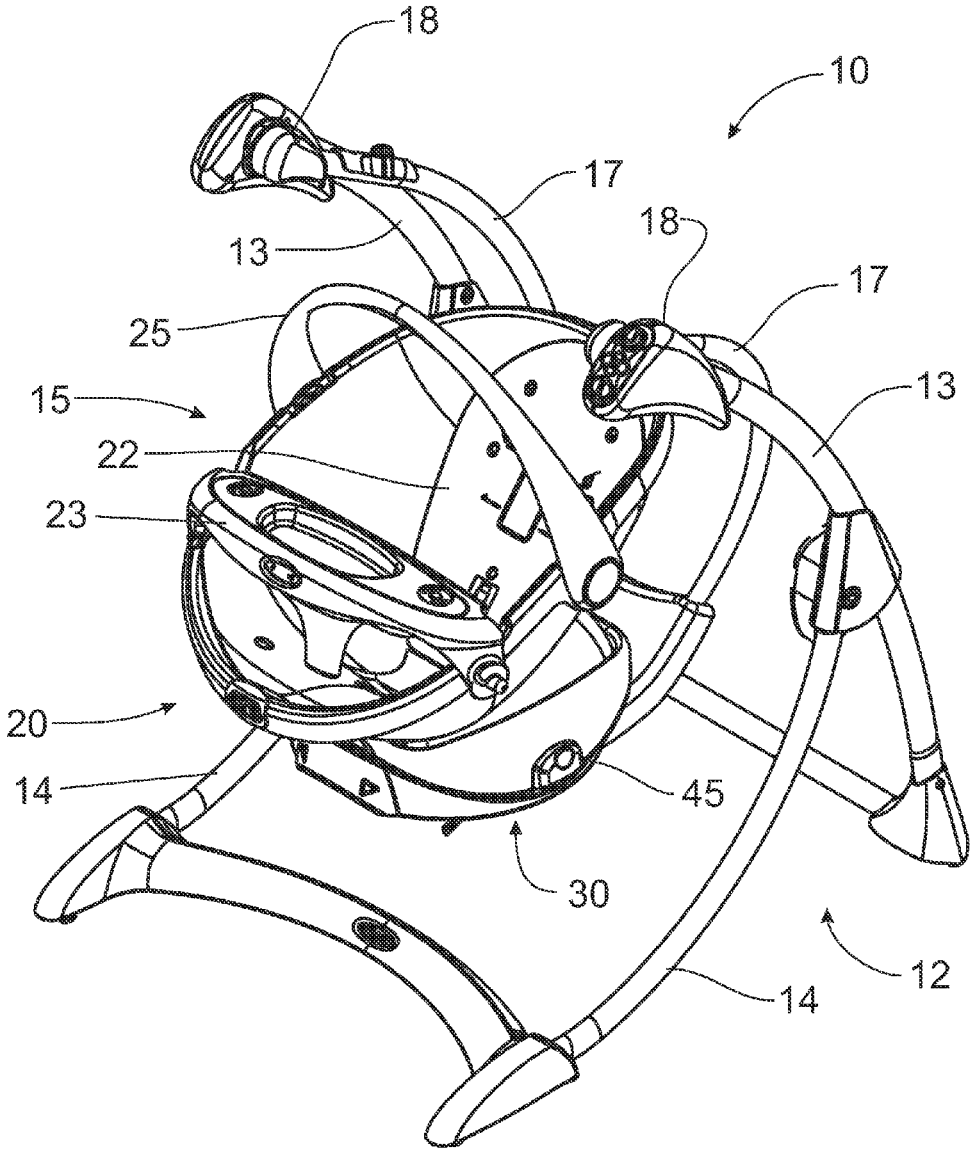
FIG. 1 is a upper front perspective view of the infant swing incorporating the principles of the instant invention.
Figure 2:
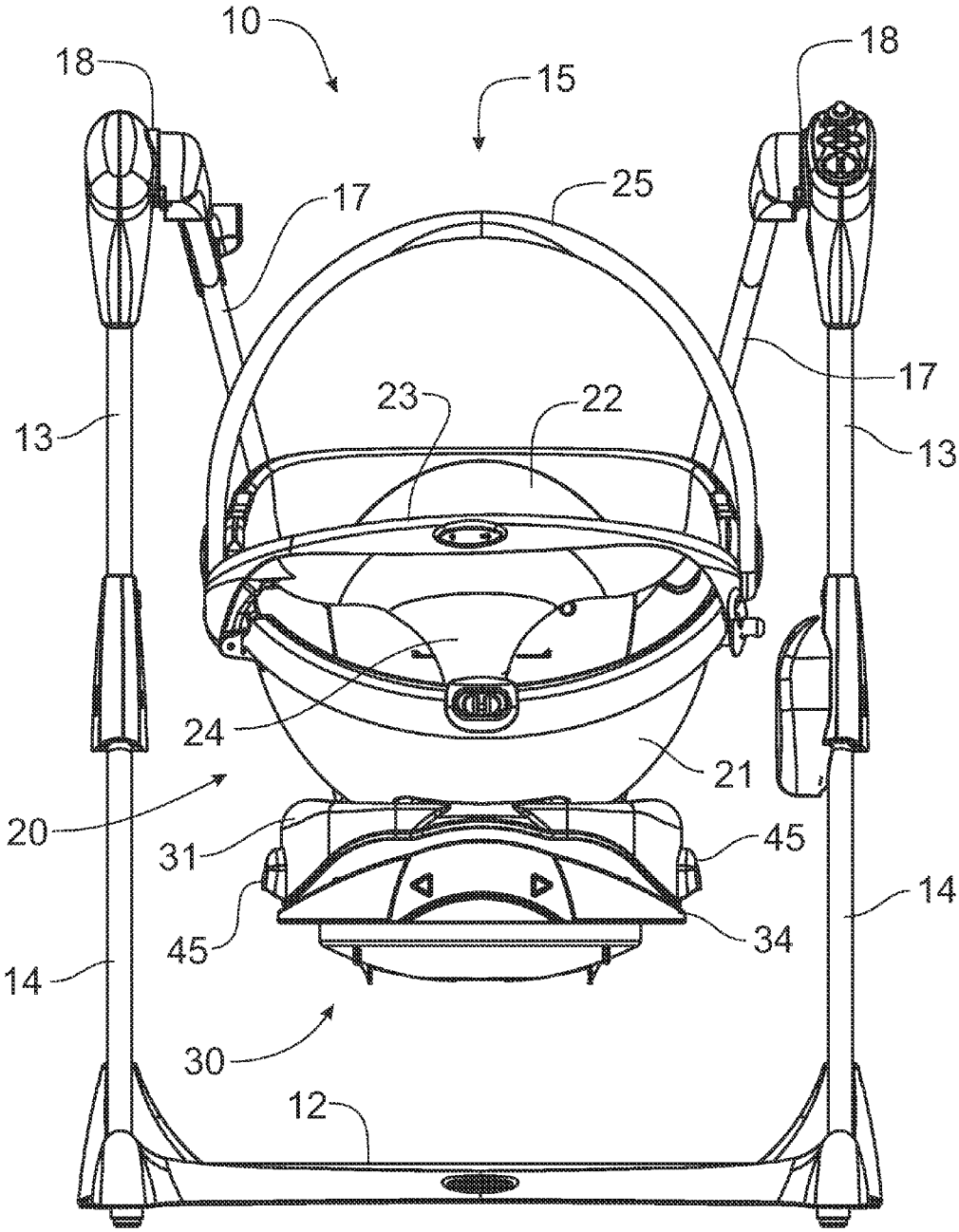
FIG. 2 is a front elevational view of the infant swing depicted in FIG. 1.
Figure 3:
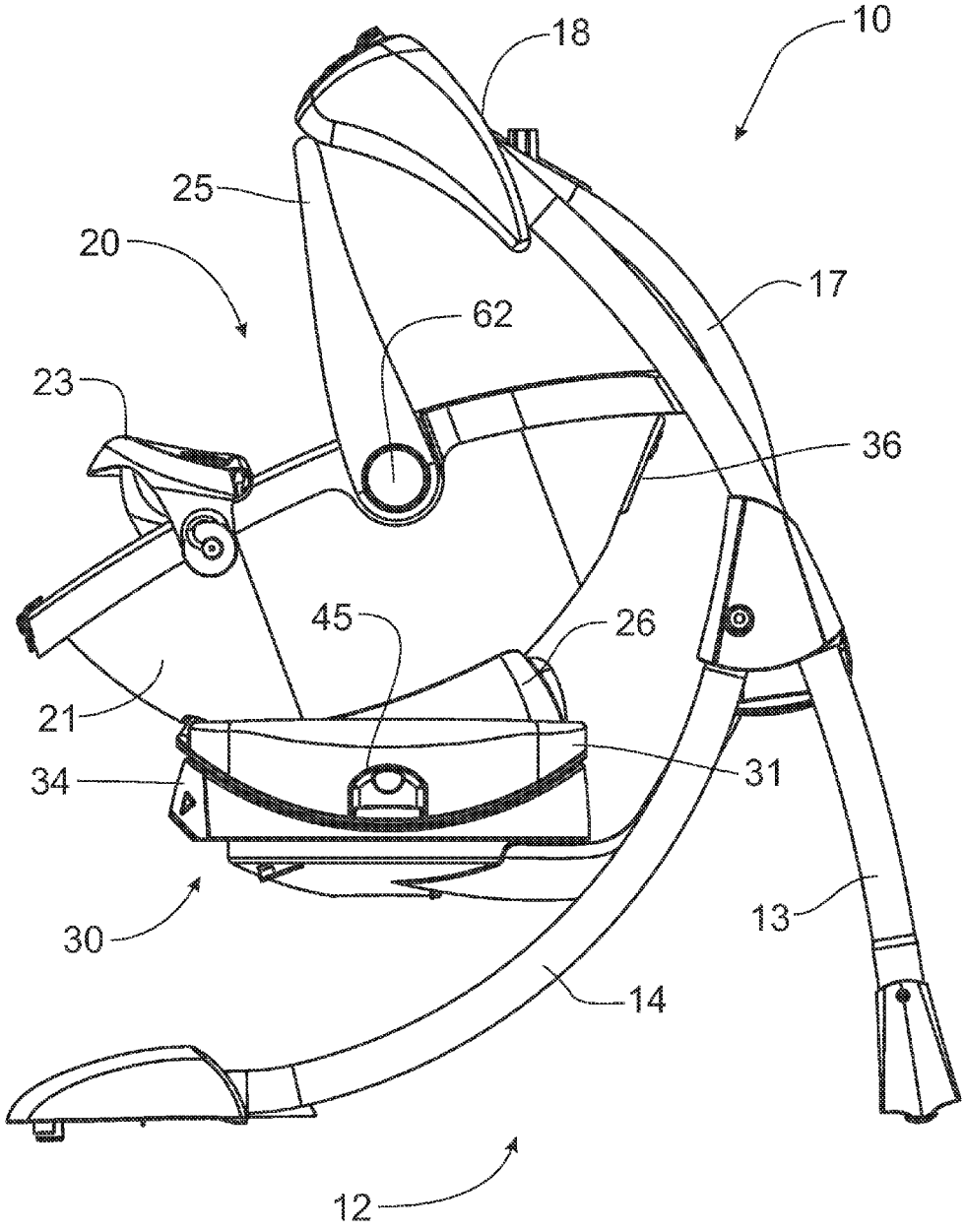
FIG. 3 is a left side elevational view of the infant swing shown in FIGS. 1 and 2.
Figure 4:
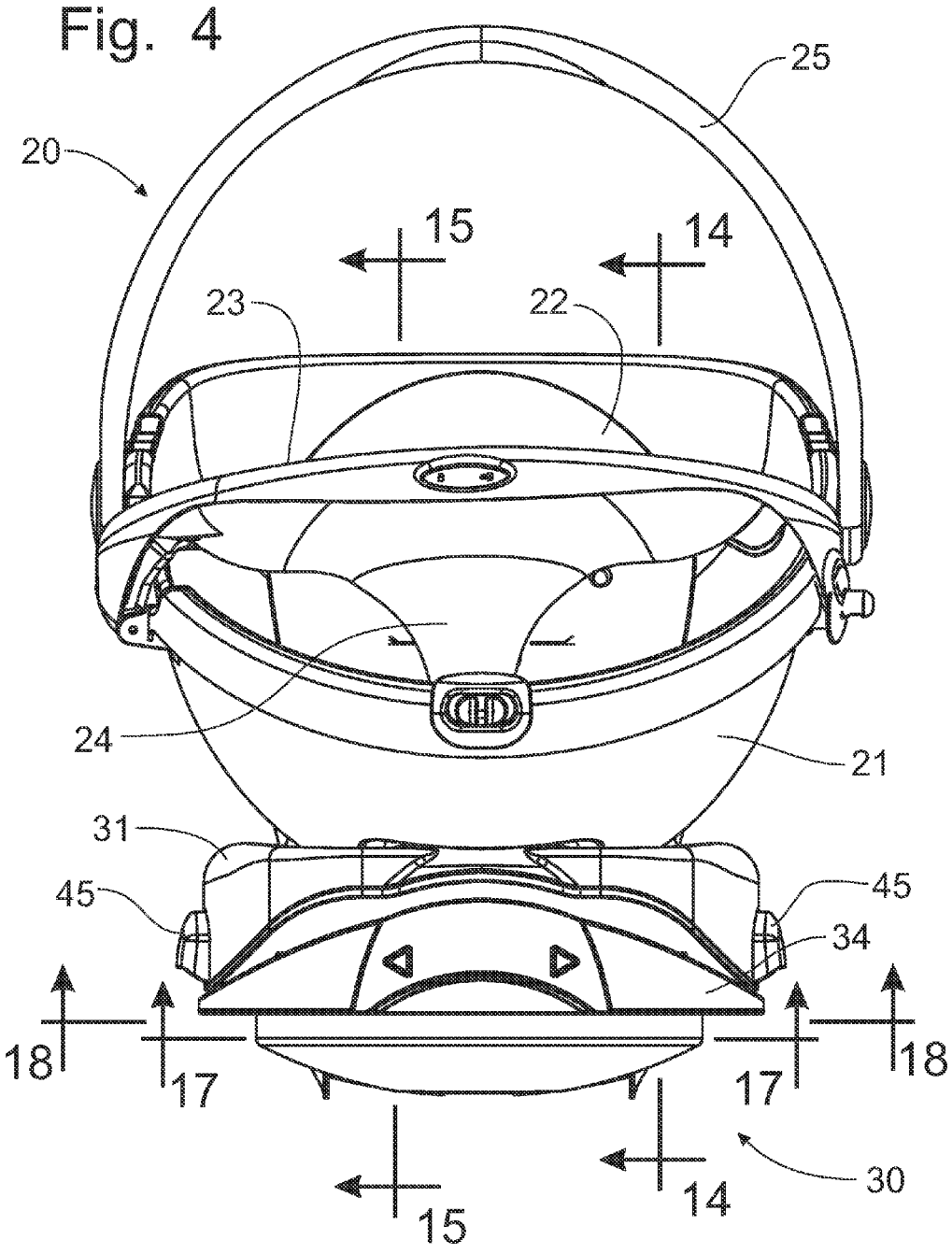
FIG. 4 is a front elevational view of the seat carrier mounted on the base member with the hanger tubes and support frame of the infant swing shown in FIG. 2 being broken away for purposes of clarity.
Figure 5:
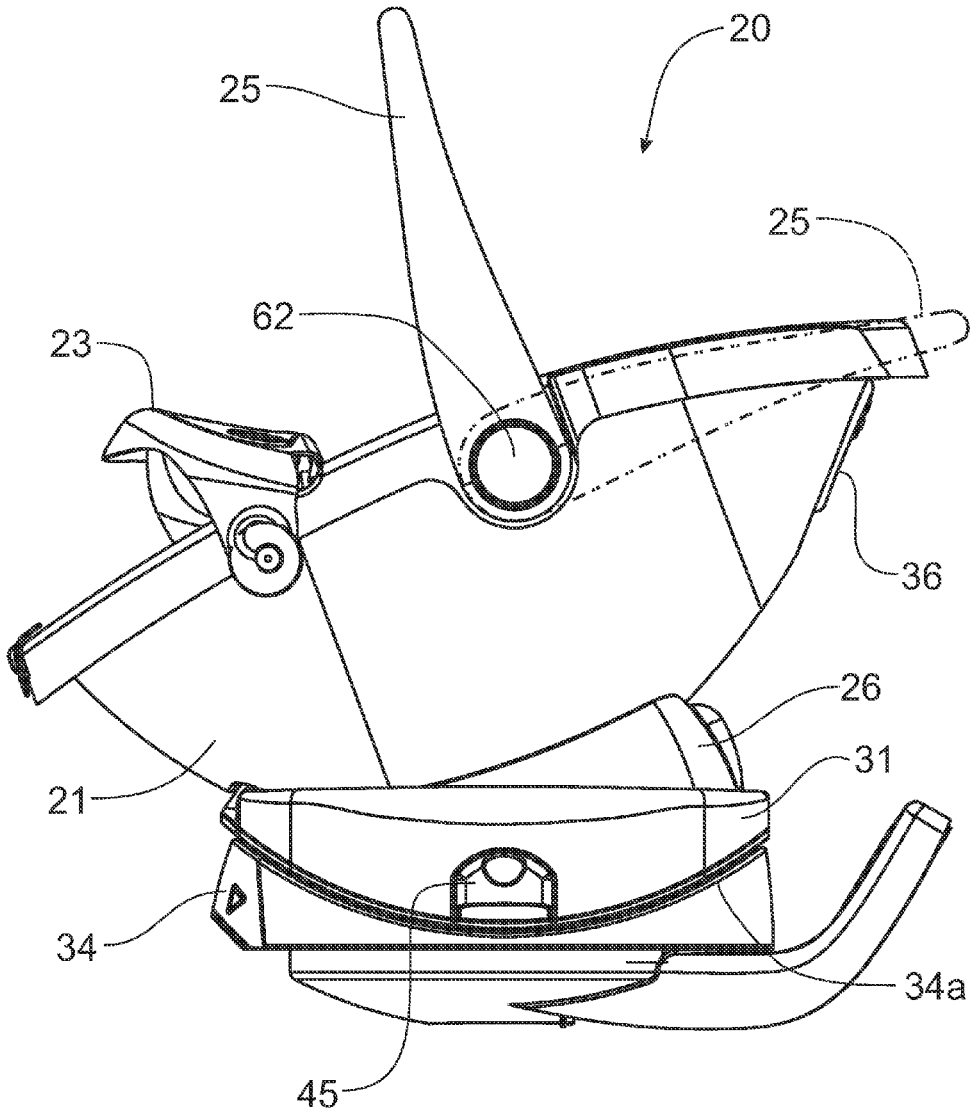
FIG. 5 is a left side elevational view of the seat carrier and base member shown in FIG. 4, the folded position of the carrier handle being shown in phantom.
Figure 6:
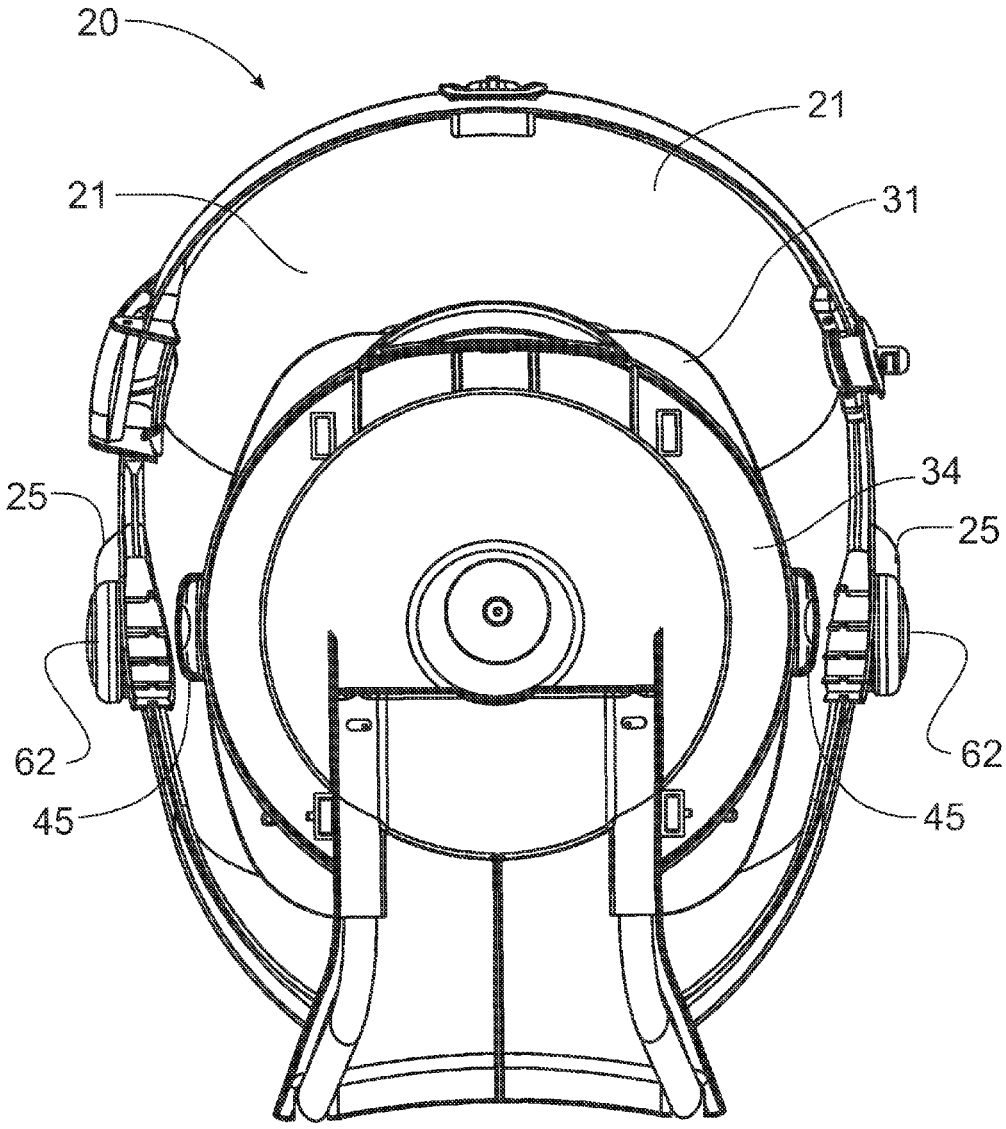
FIG. 6 is a bottom plan view of the seat carrier and base member shown in FIGS. 4 and 5.
Figure 7:
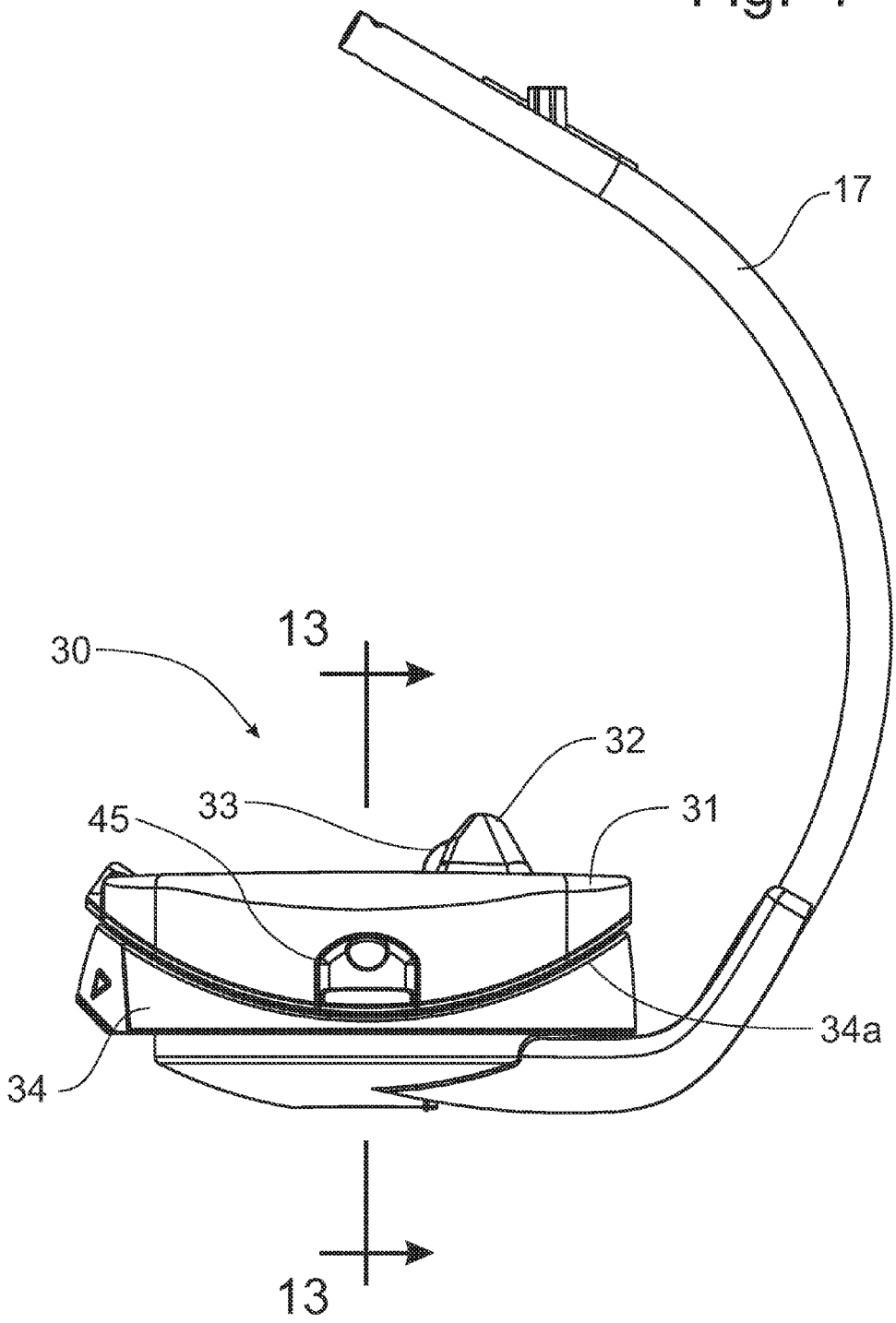
FIG. 7 is a left side elevational view of the base member supported on the hanger tubes.

Referring now to the drawings, an infant swing incorporating the principles of the instant invention can best be seen. The infant swing 10, as can best be seen in FIGS. 1-3, includes as the major components thereof a support frame assembly 12, including a pair of transversely spaced rear legs 13 and a corresponding pair of front legs 14, and a seat assembly 15 suspended from the frame assembly 12 to induce a fore-and-aft reciprocal swinging movement in the seat assembly 15. As will be described in greater detail below, the seat assembly 15 is formed of a molded seat carrier 20 mounted on a base member 30 affixed to a pair of transversely spaced hangers 17 that are connected to corresponding hanger housings 18 positioned at the cantilevered ends of the rear legs 13.

Referring now to FIGS. 4-12, the seat carrier 20 can be configured for use in multiple applications, such as a car seat or a stroller, in addition to being used in the infant swing assembly 10 as will be described in detail below. The seat carrier 20 is preferably formed with an exterior shell 21 supporting a seat 22 onto which an infant is supported and restrained. The exterior shell 21 may have a removable tray 23 mounted at a forward position and defining a yoke 24 that prevents an infant from sliding forwardly out of the seat 22. The exterior shell 21 is also provided with a pivoted lift handle 25 that is movable between an upright position, shown in FIGS. 4 and 5, and a folded or retracted position which is shown in phantom in FIG. 5. One skilled in the art will recognize that the exterior shell of the seat carrier 20 is the preferred embodiment for the seat carrier 20, but that the seat carrier can be formed in other configurations to establish an infant carrier structure. Such alternative structures would include an exterior frame that would be capable of supporting the lift handle 25 and also support soft goods that define the infant seat. In general terms, an infant carrier is intended to identify any transportable infant carrying device.

As is best seen in FIGS. 8 and 9, the underside of the exterior shell 21 is formed with mounting structure 26 that is engagable with the base member 30. The mounting structure 26 includes a receptacle 27 that is formed to receive the mounting protrusion 32 of the base member 30 so that the seat carrier 20 is not horizontally movable relative to the base member 30. The receptacle 27 includes a latch opening 28 into which the latch member 33, biased by the spring members 33*a* to project outwardly from the receptacle 27 and pivotally mounted on the base member mounting protrusion 32, can pass to secure the seat carrier 20 on the base member 30 against vertical movement of the seat carrier 20. The mounting structure 26 is also preferably formed with an arcuate lower surface that allows the seat carrier 20 to be supported on a flat surface and be rocked. To negate this rocking motion, the mounting structure 26 can be provided with an extendable brace 29 that can selectively extend out of the back side of the mounting structure 26 to provide a stable, non-rocking support surface for the free-standing seat carrier 20.

Figure 10:
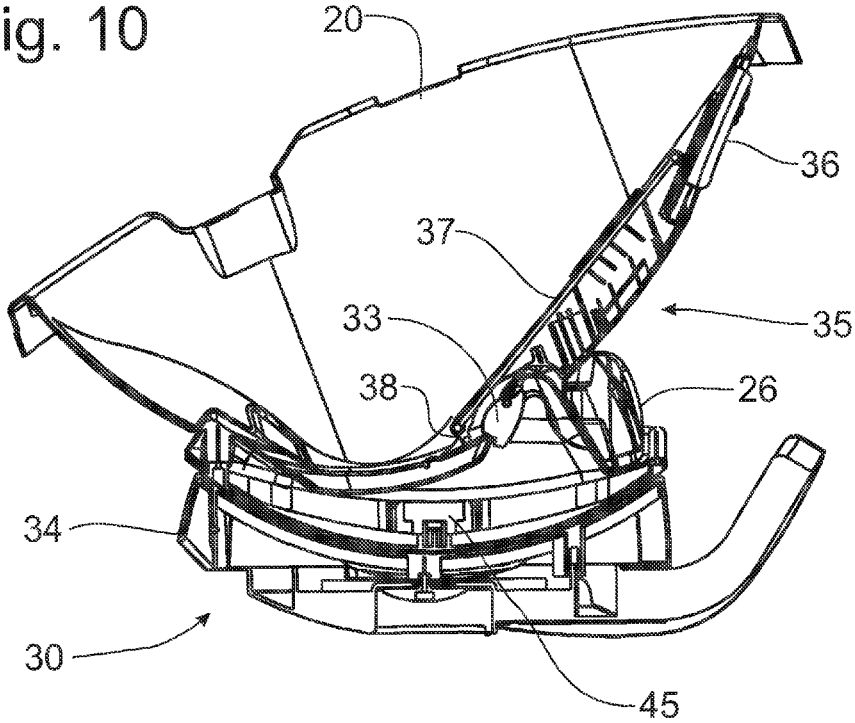
FIG. 10 is a cross-sectional view of the seat carrier mounted on the base member to show the latching mechanism for detachably securing the seat carrier on the base member.

The seat carrier 20 includes a latch actuation mechanism 35, best seen in FIGS. 10-12, operable to cause a pivotal movement of the latch member 33 to release the seat carrier 20 for vertical movement relative to the base member 30 and allow the seat carrier 20 to be lifted off the swing 10 and be removed therefrom. The latch actuation mechanism 35 includes an external pull member 36 that is connected via a pair of transversely spaced links 37 to a spring-loaded actuator 38 pivotally mounted to the exterior shell 21. When the latch member 33 snaps into the latch opening 28, the latch member 33 presses against the actuator 38. Pulling on the external pull member 36 causes a pivotal movement of the actuator 38 against the bias exerted thereon by the spring members 39 to push the latch member 33 out of the latch opening 28 and allow the seat carrier 20 to be lifted off of the base member 30.

Preferably, the infant swing 10 incorporates a recline mechanism 40, best seen in FIGS. 13-17. One of ordinary skill in the art will note that the recline mechanism 40 is housed within the base member 30, which is formed with a lower, fixed base shell 34 that is secured to the hanger members 17 and movable therewith. A top plate 31, which includes the mounting protrusion 32, is movably mounted on the fixed base shell 34 and slidable along an arcuate track 34*a*. As can be seen best in FIG. 16, the top plate 31 is supported on rollers 41 that project upwardly through the upper face 63 of the base shell 34 to facilitate the sliding movement of the top plate 31 relative to the base shell 34. The base shell 34 is formed with longitudinally extending slots 42 through which the mounting tab 44 of slide retainers 43 extend so that the top plate 31 can be secured to the slide retainers 43 which run under the upper face 63 of the fixed shell 34. With this structure, the top plate 31 is free to move along the arcuate track 34*a* without being separable from the fixed shell 34. The slide retainers 43 prevent the top plate 31 from separating from the fixed base shell 34 without hindering the sliding movement thereof, while the rollers 41 minimize any friction between the top plate 31 and the base shell 34.

The recline mechanism 40 further includes a push/pull actuator handle 45 that spans transversely across the base member 30 to project outboard thereof on both sides of the base member 30. The actuator handle 45 is carried by the top plate 31 and includes a center chamber 46 having a bottom opening therein to receive a center post 47 formed in the top plate 31. The center chamber 46 carries a pair of springs 48 positioned on opposing sides of the center post 47 to center the actuator handle 45 on the top plate 31 and bias the actuator handle 45 to a centered position. The actuator handle 45 also is formed with a pair of downwardly extending protrusions 49 that are engagable, respectively, with corresponding formed locking channels 50.

Figure 16:
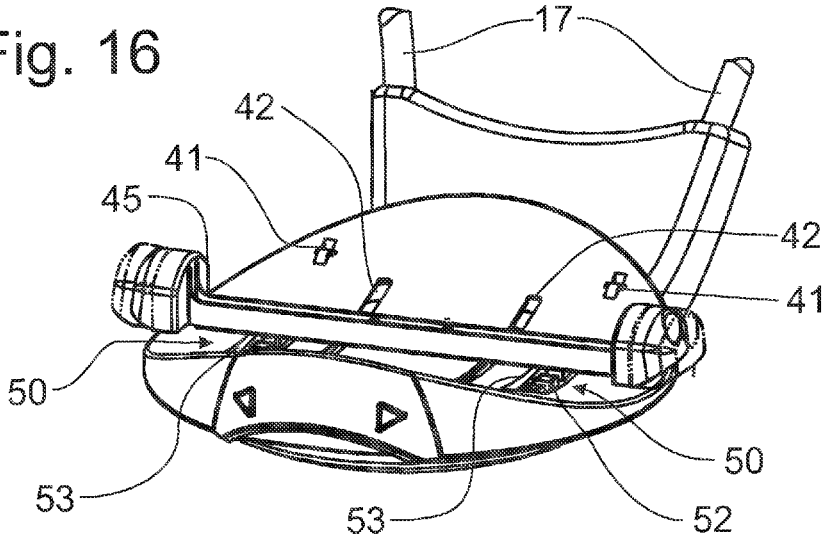
FIG. 16 is a perspective view of the base member with the top plate broken away to show the actuator handle and the slotted channels in the fixed base member, movement of the actuator handle being depicted in phantom.
Figure 13:
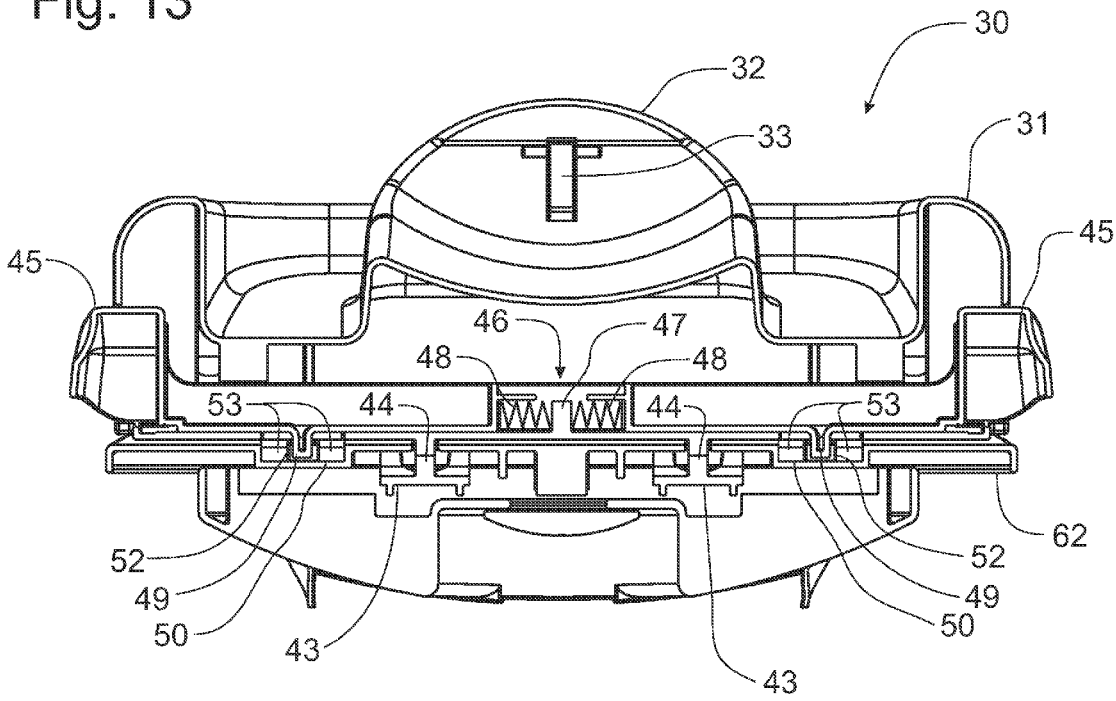
FIG. 13 is an enlarged cross-sectional view of the base member taken along lines 13-13 of FIG. 7 to depict the recline actuation mechanism.
Figure 17:
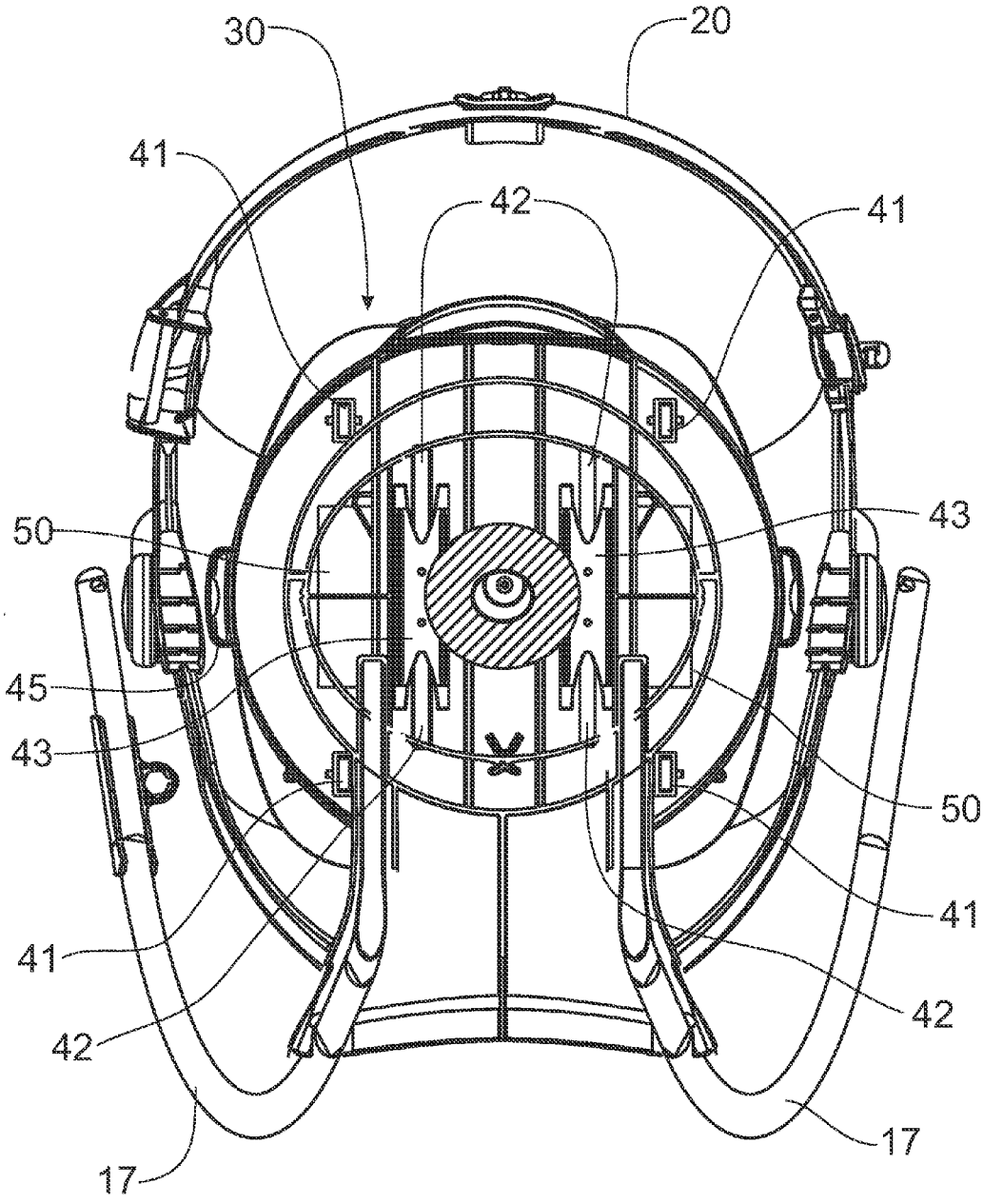
FIG. 17 is a cross-sectional view of the base member taken along lines 17-17 of FIG. 4 to show the underside of the recline mechanism.

Each locking channel 50 is formed as a depression into the face 63 of the base shell 34 so that the protrusions 49 are received therein. Each locking channel 50 is formed with a series of longitudinally spaced blocks 52, as is best seen in FIGS. 14 and 16, with a longitudinal passageway 53 located on the transversely opposing sides of the blocks 52, which in turn are separated by transversely extending grooves 54 that interconnect the transversely spaced passageways 53. When the actuator handle 45 is in the centered position, the protrusions are located within the transverse grooves 54 between selected blocks 52. Pushing the actuator handle 45 to either side against the biasing force exerted by the corresponding centering spring 48 causes the protrusions 49 to move sideways into the corresponding longitudinal passageway 53. The top plate 31 is then free to move along the arcuate track 34*a* relative to the base shell 34 within the parameters defined by the longitudinal passageways 53.

When the caregiver has selected the desired reclined position, the actuator handle 45 is allowed to return to the centered position which will then position the protrusions 49 within the transverse grooves 54 between the blocks 52. The blocks 52 serve to prevent longitudinal movement of the protrusions 49 and, thus, movement of the top plate 31 relative to the base shell 34. Preferably, several blocks 52 are utilized in the locking channels 50 so that at least five recline positions are defined by the transverse grooves 54. One skilled in the art will recognize that other numbers of transverse grooves 54, and the corresponding recline positions, can be defined by a selected number of blocks 52 within the depressed locking channel 50.

Figure 18:
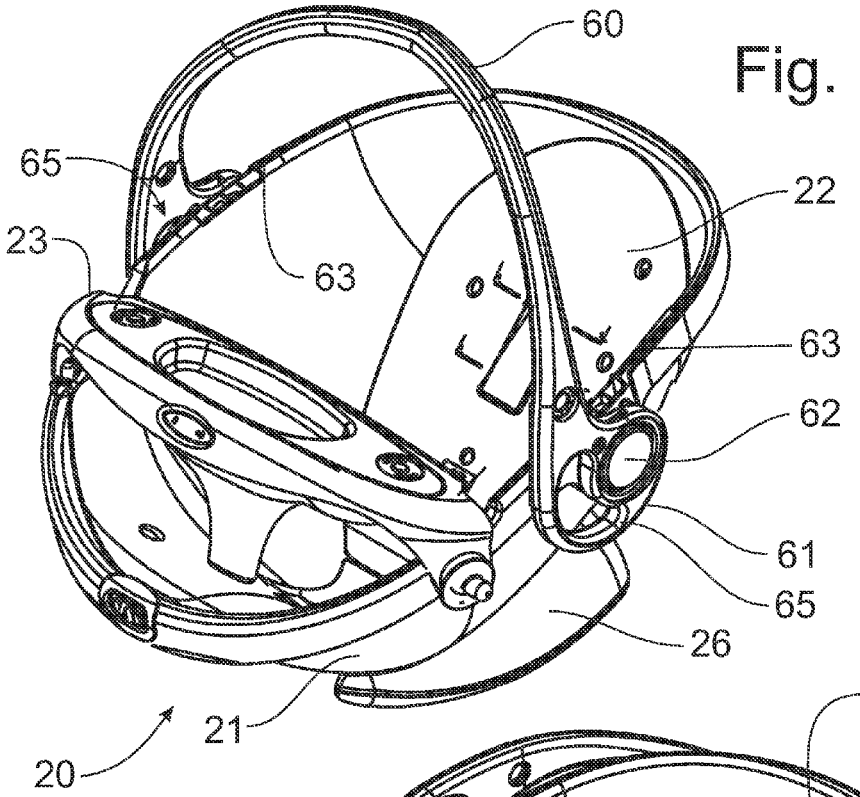
FIG. 18 is an upper, left, front perspective view of the seat carrier having a dual lift function lift handle incorporating the principles of the instant invention, the lift handle being shown in the raised overhead operative position.

With reference to FIGS. 18-22, the lift handle 60 can be formed in an embodiment that incorporates a dual lift function capability. The lift handle 60 can include a widened base portion 61 that includes the pivot connection 62 with the seat carrier 20 at each respective end of the lift handle 60 and a grip opening 65 formed forwardly of the corresponding pivot connection 62. When the lift handle 60 is positioned in the raised overhead configuration, as is depicted in FIGS. 18 and 20 and in phantom in FIG. 22, the grip openings 65 are located below the top edge 63 of the seat carrier 20, thus limiting the effectiveness of the grip openings 65 to provide a two-hand lift function. One skilled in the art will recognize that the grip openings 65, shown in cross-section in FIG. 28, can be formed with a wall 66 that converts the grip opening 65 into a grip member 68, as is depicted in FIG. 29. While the wall 66 prevents the caregiver's fingers from passing through the grip member 68, as they would for a grip opening 65, the formed grip member 68 provides adequate engagement structure, particularly when positioned above the top edge 63, as is described below. The further reference to grip openings 65 below is intended to include reference to the grip members 68.

Figure 19:
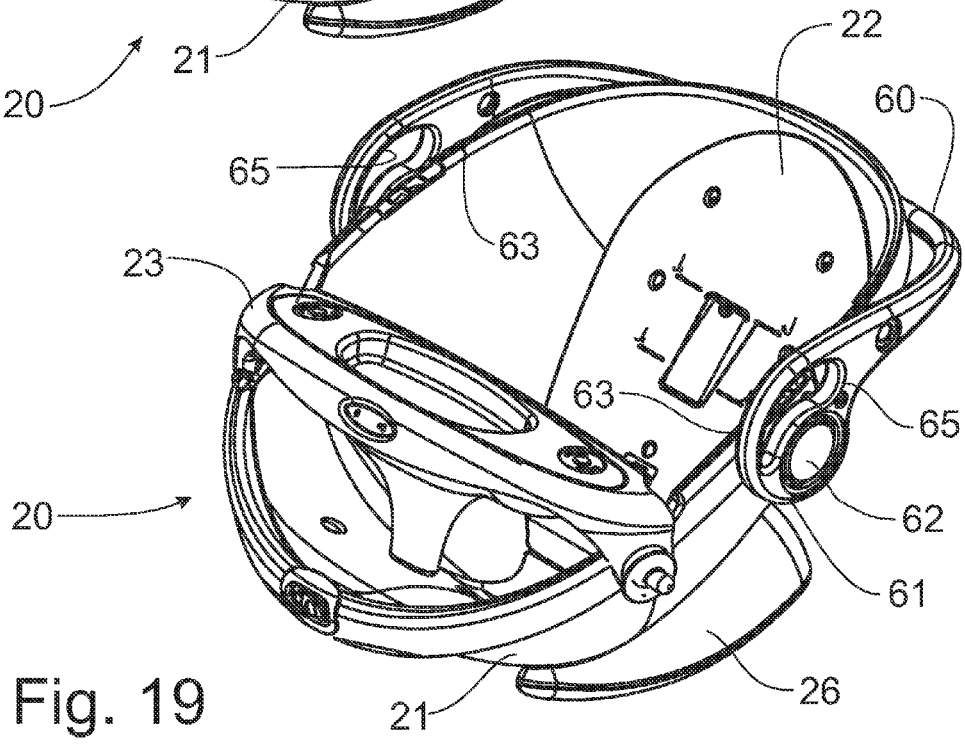
FIG. 19 is a perspective view similar to that of FIG. 18, but depicting the lift handle in the lowered, folded position that rotates the grip openings into an accessible orientation.
Figure 22:
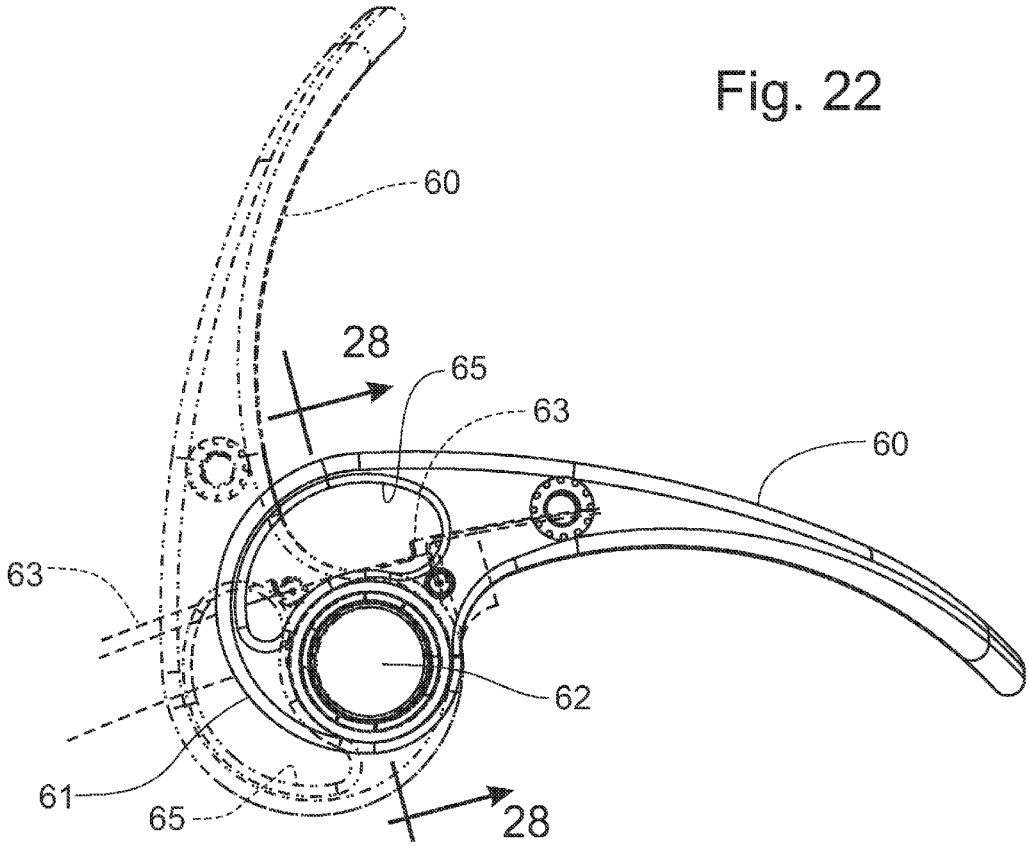
FIG. 22 is an enlarged elevational detail view of the dual lift function lift handle, the upright orientation being shown in phantom and the corresponding top edge of the seat carrier being shown in dashed lines.
Figure 23:
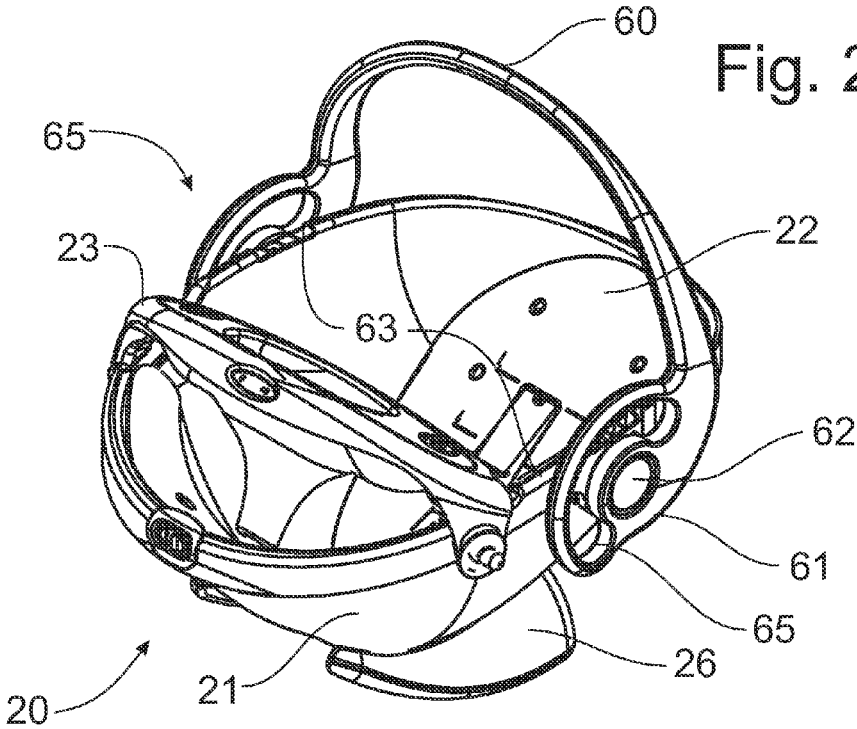
FIG. 23 is an upper, left, front perspective view of the seat carrier having an alternative embodiment of the dual lift function lift handle shown in the raised overhead operative position.
Figure 24:
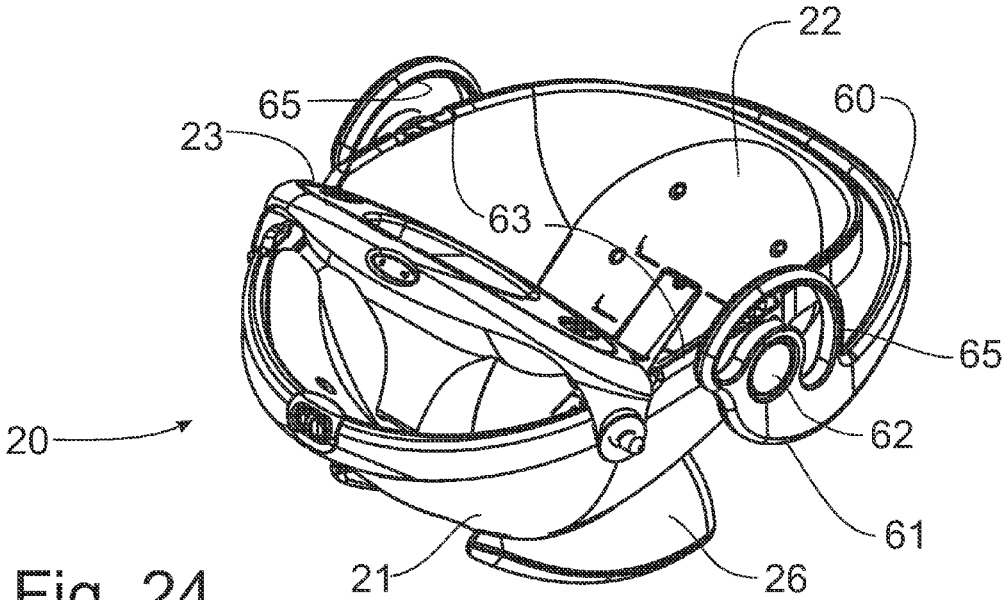
FIG. 24 is a perspective view similar to that of FIG. 23, but depicting the lift handle in the lowered, folded position.
Figure 25:
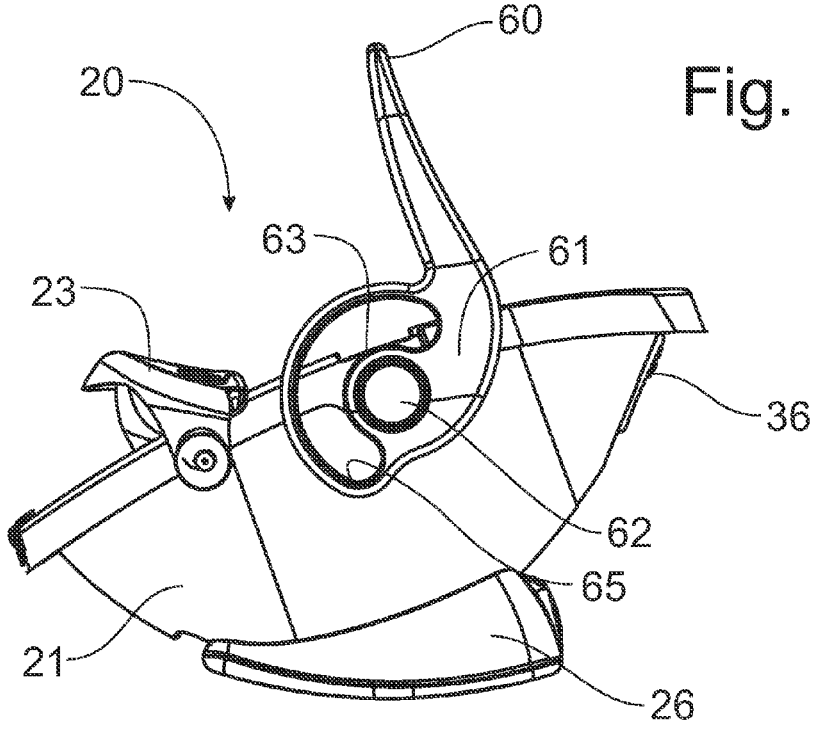
FIG. 25 is a left side elevational view of the seat carrier of FIG. 23.
Figure 26:
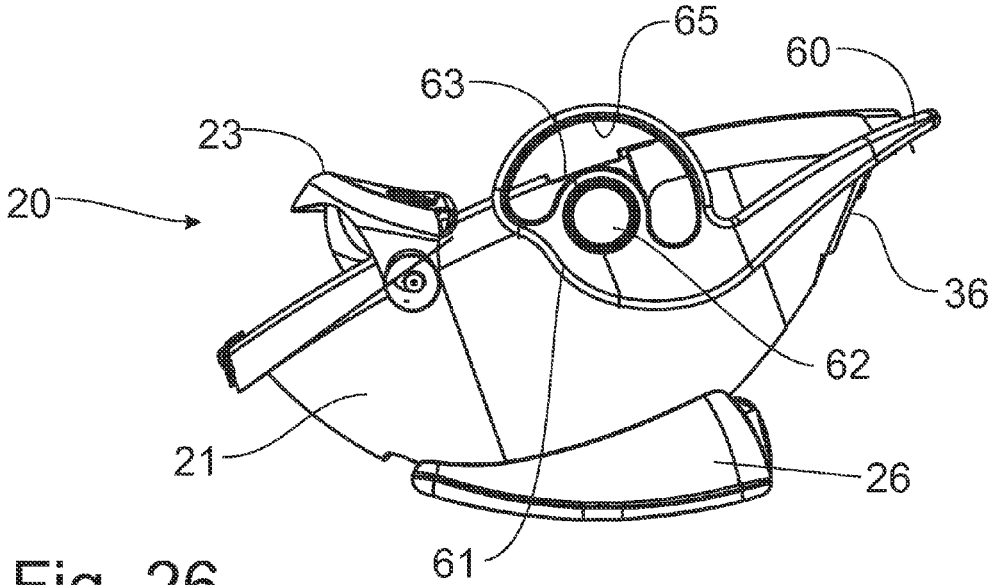
FIG. 26 is a left side elevational view of the seat carrier of FIG. 24.
Figure 27:
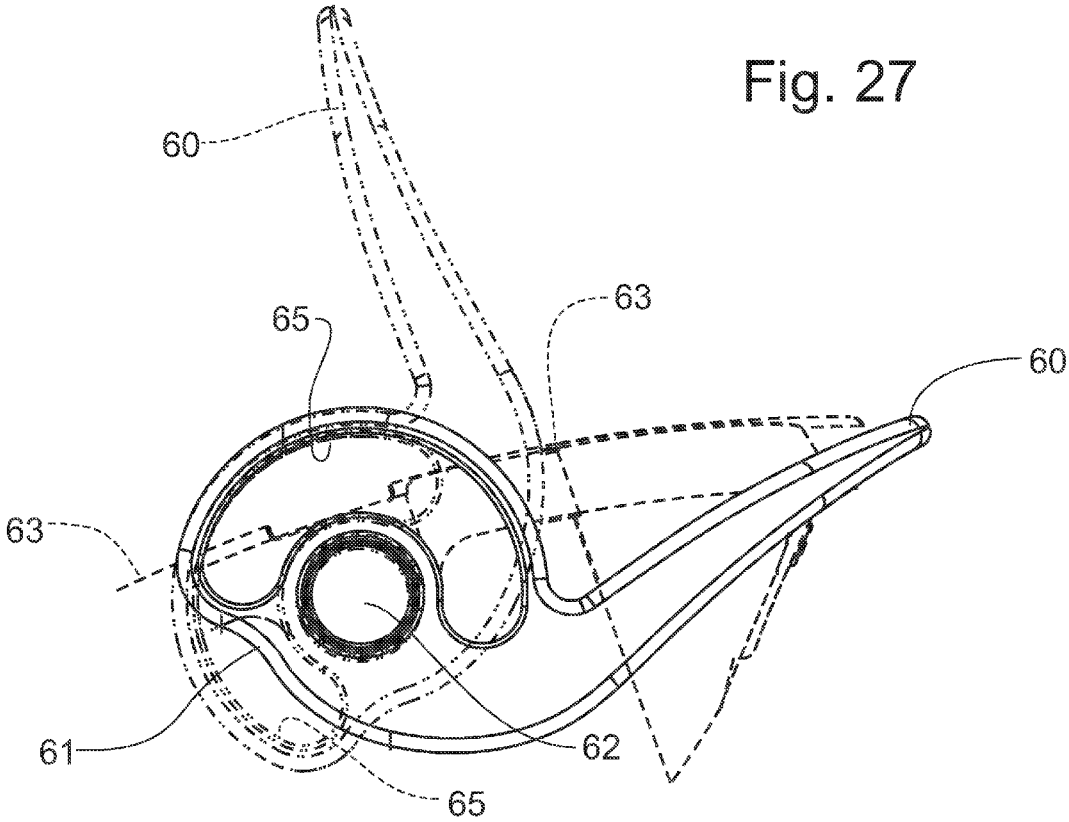
FIG. 27 is an enlarged elevational detail view similar to that of FIG. 22, but showing an alternative embodiment of the dual lift function lift handle.

However, when the lift handle 60 is lowered to the folded position, as can be seen in FIGS. 19, 21 and 22, the pivotal movement of the lift handle 60 re-orients the grip openings 65 from forwardly of the pivot axis 62 to a position vertically above the pivot axis 62. In this location, the caregiver can insert fingers through the grip openings 65, or grasp the grip members 68, and, using two hands, lift the seat carrier from one location to another. Since the grip opening 65 is located vertically above the pivot 62 of the handle 60, the seat carrier 20 can be lifted by the grip openings 65 without pivoting the handle 60. Thus, the lift handle 60 provides a lift function even when lowered into the normally inoperative folded position.

In FIGS. 23-27, an alternative embodiment of the grip openings 65 is depicted. While in the first embodiment shown in FIG. 22 is operable only when the handle 60 is lowered to the folded position, the grip openings 65 in this alternative embodiment are formed in a semi-circular configuration to wrap approximately 180 degrees around the pivot 62. With such a configuration of the grip openings 65, a first portion of the grip openings 65 will be located below the top edge 63, while a second portion is located above the top edge when the handle is in the upright position. Thus, the grip openings 65 are operable to provide a two-hand lift function even when the handle 60 is upright. When the handle 60 is pivoted to the lowered position, the first portion of the grip openings 65 are rotated above the top edge 63 to provide the two-hand lift function when the handle 60 is lowered, as well as when the handle 60 is raised.

In operation, the seat carrier 20 can be transferred from one application, such as a car seat, with the infant asleep therein and placed onto the base member 30 without waking the infant due to moving the infant from one seat to another. The seat carrier 20 automatically snaps into place by the spring-loaded latch member 33 deflecting due to engagement with the mounting structure 26 and locking into the latch opening 28 in the receptacle 27. By depressing the recline actuation handle 45 from either side of the seat carrier 20, the seat carrier 20 can be reclined to a desired orientation, whereupon the recline actuation handle 45 is released to allow the centering springs 48 to move the protrusions 49 into an interfering position with respect to the blocks 52 in the locking channels 50, the protrusions 49 passing into transverse grooves 54 between corresponding blocks 52.

The dual lift function lift handle 60 can provide a one-hand lift function when the lift handle 60 is raised into the upright, overhead position, and a two-hand lift function when the lift handle is lowered into the folded position by virtue of the pivotal movement of the lift handle re-orienting the grip openings 65 into an accessible position above the top edge of the seat carrier 20. Accordingly, the dual lift function lift handle 60 does not have to be raised in order to allow the seat carrier to be moved from one location to another.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A child swing comprising:

a frame assembly operable to induce a reciprocal movement relative to said frame assembly; and a seat assembly including a hanger apparatus connected to said frame assembly so as to be operable to move in a reciprocal manner relative to said frame assembly, said seat assembly including:

a base member mounted on a distal end of said hanger apparatus, said base member including a top plate having an upwardly extending mounting protrusion located generally centrally thereon and a base shell meeting said top plate at an arcuate interface defining a track, said mounting protrusion including a latch member;

a seat carrier having a receiver structure formed generally centrally on a lower portion thereof to mate with said mounting protrusion to permit said seat carrier to be detachably mountable on said base member for reciprocal movement with said base member and said hanger apparatus, said receiver structure including a latch opening engagable by said latch member to secure said seat carrier to said base member, said seat carrier and said attached top plate being movable along said track in a fore-and-aft direction relative to said base shell to allow said seat carrier to be oriented in a selected recline position; and a latch actuation mechanism on said seat carrier including:

an external actuation member accessible on an exterior side of said seat carrier:

an actuator mounted within said receiver structure adjacent said latch opening, said actuator being spring-biased away from said latch opening; and links connecting said actuation member and said actuator such that a manipulation of said actuation member can affect movement of said actuator against the spring bias exerted thereon to engage said latch member and cause deflection thereof out of said latch opening.

2. The child swing of claim 1 wherein said latch member is spring-loaded for extension outwardly from said mounting protrusion for engagement into said latch opening.

3. The child swing of claim 1 wherein said seat carrier includes a lift handle pivotally connected to said seat carrier and being pivotally movable between an upright overhead position and a lowered folded position.

4. The child swing of claim 3 wherein said lift handle is pivotally connected to said seat carrier by a pivot located on laterally opposing sides of said seat carrier, said lift handle being formed with a grip opening adjacent each said pivot.

5. The child swing of claim 4 wherein said grip openings are formed with a portion thereof located forwardly of said pivot and below a top edge of said seat carrier when said lift handle is in said upright overhead position, the pivotal movement of said lift handle into said lowered position rotating said grip openings such that said portion is located above said top edge of said seat carrier for access in lifting said seat carrier.

6. In a child swing having a frame assembly operable to induce a reciprocal movement relative to said frame assembly, and a seat assembly including a hanger apparatus connected to said frame assembly so as to be operable to move in a reciprocal manner relative to said frame assembly, the improvement comprising:

a base member having a generally centrally positioned mounting protrusion projecting upwardly therefrom, said base member being mounted on a distal end of said hanger apparatus;

a seat carrier defining a receiver structure formed generally centrally on a lower portion of said seat carrier to mate with said mounting protrusion and permit said seat carrier to be detachably mounted on said base member for reciprocal movement with said base member and said hanger apparatus, said receiver structure including a latch opening, said mounting protrusion including a latch member engagable into said latch opening to secure said seat carrier to said base member; and a latching mechanism including an external actuation member accessible on a exterior side of said seat carrier; an actuator mounted within said receiver structure adjacent said latch opening, said actuator being spring-biased away from said latch opening; and links connecting said actuation member and said actuator such that a manipulation of said actuation member can affect movement of said actuator against a spring bias exerted thereon to engage said latch member and cause deflection thereof out of said latch opening, said actuator abutting against said latch member when said latch member is engaged in said latch opening and being operable to push said latch member out of said latch opening.

7. The child swing of claim 6 wherein said latch member is spring-loaded for extension outwardly from said mounting protrusion for engagement into said latch opening.

8. The child swing of claim 6 wherein said base member includes a top plate carrying said mounting protrusion for engagement with said receiver structure on said seat carrier, and a base shell meeting said top plate at an arcuate interface defining a track along which the seat carrier and attached top plate can move in a fore-and-aft direction relative to said base shell.

9. The child swing of claim 6 wherein said seat carrier includes a lift handle pivotally connected to said seat carrier and being pivotally movable between an upright overhead position and a lowered folded position.

10. The child swing of claim 9 wherein said lift handle is pivotally connected to said seat carrier by a pivot located on laterally opposing sides of said seat carrier, said lift handle being formed with a grip opening adjacent each said pivot.

11. The child swing of claim 10 wherein said grip openings are formed with a portion thereof located forwardly of said pivot and below a top edge of said seat carrier when said lift handle is in said upright overhead position, the pivotal movement of said lift handle into said lowered position rotating said grip openings such that said portion is located above said top edge of said seat carrier for access in lifting said seat carrier.

12. A child swing comprising:

a frame assembly operable to induce a reciprocal movement relative to said frame assembly;

a hanger apparatus connected to said frame assembly so as to be operable to move in a reciprocal manner relative to said frame assembly;

a base member mounted on a distal end of said hanger apparatus, said base member including a top plate formed with an upwardly extending mounting protrusion located generally centrally on said base member, said base member also including a base shell meeting said top plate at an arcuate interface defining a track;

a seat carrier having a receiver structure formed generally centrally on a lower portion thereof to mate with said mounting protrusion to permit said seat carrier to be detachably mountable on said base member for reciprocal movement with said base member and said hanger apparatus, said seat carrier and attached top plate being movable in a fore-and-aft direction relative to said base shell to allow said seat carrier to be oriented in a selected recline position; and a latch mechanism including a latch opening, a spring-loaded latch member engagable with said latch opening, and a latch actuator operably connected to said latch member for selectively securing said seat carrier to said base member, said latch actuator including:

an external actuation member accessible on a exterior side of said seat carrier;

an actuator mounted within said receiver structure adjacent said latch opening, said actuator being spring-biased away from said latch opening; and links connecting said actuation member and said actuator such that a manipulation of said actuation member can affect movement of said actuator against the spring bias exerted thereon to engage said latch member and cause deflection thereof out of said latch opening.

13. The child swing of claim 12 wherein said latch opening is located in said receiver structure and said latch member is located on said mounting protrusion.

14. The child swing of claim 13 wherein said seat carrier includes a lift handle pivotally connected to said seat carrier and being pivotally movable between an upright overhead position and a lowered folded position.

15. The child swing of claim 14 wherein said lift handle is pivotally connected to said seat carrier by a pivot located on laterally opposing sides of said seat carrier, said lift handle being formed with a grip opening adjacent each said pivot.

16. The child swing of claim 15 wherein said grip openings are formed with a portion thereof located forwardly of said pivot and below a top edge of said seat carrier when said lift handle is in said upright overhead position, the pivotal movement of said lift handle into said lowered position rotating said grip openings such that said portion is located above said top edge of said seat carrier for access in lifting said seat carrier.

17. A child swing comprising:

a frame assembly operable to induce a reciprocal movement;

a hanger apparatus connected to said frame assembly so as to be movable in a reciprocal manner relative to said frame assembly;

a base member mounted on a distal end of said hanger apparatus, said base member including an upwardly extending mounting protrusion; and a seat carrier having a receiver structure formed on a lower portion thereof to mate with said mounting protrusion to permit said seat carrier to be detachably mountable on said base member for reciprocal movement with said base member and said hanger apparatus, said base member including a top plate carrying said mounting protrusion for engagement with said receiver structure on said seat carrier, and a base shell meeting said top plate at an arcuate interface defining a track along which the seat carrier and attached top plate can move in a fore-and-aft direction relative to said base shell, to allow said seat carrier to be oriented in a selected recline position; and a latch actuation mechanism including:

an external actuation member accessible on an exterior side of said seat carrier;

an actuator mounted within said receiver structure adjacent a latch opening formed in said receiver structure, said actuator being spring-biased away from said latch opening; and links connecting said actuation member and said actuator such that a manipulation of said actuation member can affect movement of said actuator against the spring bias exerted thereon to engage a latch member on said mounting protrusion and cause deflection thereof out of said latch opening.

* * * * *